US012397882B2

(12) United States Patent
Warnan et al.

(10) Patent No.: US 12,397,882 B2
(45) Date of Patent: Aug. 26, 2025

(54) DEVICE FOR RECOVERING A VESSEL AT SEA

(71) Applicant: THALES, Courbevoie (FR)

(72) Inventors: François Warnan, Brest (FR); Olivier Jezequel, Brest (FR)

(73) Assignee: THALES, Courbevoie (FR)

( * ) Notice: Subject to any disclaimer, the term of this patent is extended or adjusted under 35 U.S.C. 154(b) by 586 days.

(21) Appl. No.: 17/787,305

(22) PCT Filed: Dec. 23, 2020

(86) PCT No.: PCT/EP2020/087758
§ 371 (c)(1),
(2) Date: Jun. 18, 2022

(87) PCT Pub. No.: WO2021/130306
PCT Pub. Date: Jul. 1, 2021

(65) Prior Publication Data

US 2023/0016702 A1 Jan. 19, 2023

(30) Foreign Application Priority Data

Dec. 26, 2019 (FR) ..... 1915628

(51) Int. Cl.
*B63B 27/36* (2006.01)
*B63B 27/16* (2006.01)

(52) U.S. Cl.
CPC ..... *B63B 27/36* (2013.01); *B63B 27/16* (2013.01)

(58) Field of Classification Search
CPC ..... B63B 27/36; B63B 27/16
See application file for complete search history.

(56) References Cited

U.S. PATENT DOCUMENTS 2,113,338 A * 4/1938 Wohldorf ..... B60D 1/025 280/515
2,881,590 A * 4/1959 Zaskey ..... E02B 17/024 405/209

(Continued)

FOREIGN PATENT DOCUMENTS

DE 275 219 A1 1/1990
FR 3062844 A1 * 8/2018 ..... B63B 27/36

(Continued)

*Primary Examiner* — S. Joseph Morano
*Assistant Examiner* — Jovon E Hayes
(74) *Attorney, Agent, or Firm* — BakerHostetler

(57) ABSTRACT

A device for recovering a vessel at sea from a surface station, the recovery device includes a cradle intended to support the vessel, a lifting device comprising an upper frame and a set of hangers connecting the cradle to the upper frame, lengths of the hangers being variable so as to make it possible to hoist and lower the cradle, a first stabilizing hanger and a second stabilizing hanger being able to be in a stabilizing configuration wherein the first stabilizing hanger and the second stabilizing hanger are under tension and extend linearly, and wherein a first orthogonal projection of the first stabilizing hanger on a transverse plane (y, z) defined by an axis z, which is linked to the upper frame and extends substantially vertically in calm seas, and by an axis y orthogonal to the axis z, and a second orthogonal projection of the second stabilizing hanger on the transverse plane are inclined with respect to one another so as to make it possible to limit swaying of the cradle with respect to the upper frame.

14 Claims, 12 Drawing Sheets

(56) References Cited

U.S. PATENT DOCUMENTS

| | | | | | |
|---|---|---|---|---|---|
| 3,756,446 | A * | 9/1973 | Macrander | ..... | B63B 27/36<br>114/260 |
| 6,178,914 | B1 * | 1/2001 | Axelsson | ..... | B63B 27/36<br>114/248 |
| 6,840,188 | B1 * | 1/2005 | Witbeck | ..... | B63B 27/36<br>114/259 |
| 11,192,613 | B2 * | 12/2021 | Grall | ..... | B66C 13/02 |

FOREIGN PATENT DOCUMENTS

| | | | | | |
|---|---|---|---|---|---|
| WO | WO-9739940 | A1 * | 10/1997 | ..... | B63B 23/30 |
| WO | WO-2012069853 | A2 * | 5/2012 | ..... | B63B 23/32 |
| WO | WO-2015087074 | A1 * | 6/2015 | ..... | B63B 27/16 |
| WO | WO-2018069241 | A1 * | 4/2018 | ..... | B63B 23/26 |

* cited by examiner

DEVICE FOR RECOVERING A VESSEL AT SEA

CROSS-REFERENCE TO RELATED APPLICATIONS

This application is a National Stage of International patent application PCT/EP2020/087758, filed on Dec. 23, 2020, which claims priority to foreign French patent application No. FR 1915628, filed on Dec. 26, 2019, the disclosures of which are incorporated by reference in their entirety.

FIELD OF THE INVENTION

The invention relates to the general field of the recovery, from a surface station, of propelled surface vessels or of propelled underwater vessels. The surface station is, for example, a surface ship or a ground station, that is to say a station fixed with respect to the land, for example a seaport.

The invention relates, more particularly, to devices for recovering vessels at sea, which are installed on a surface station, and to methods for recovering vessels using these types of recovery device. The invention relates in particular to the hoisting of a vessel, from sea level to a position above sea level, for example to the level of a platform of the surface station on which the vessel is intended to be stored. The invention is particularly advantageous for the recovery of surface vessels from a surface ship, the vessel and the surface ship being able to move with respect to one another while being on one and the same wave.

BACKGROUND

A major problem with operations for recovering a propelled, floating or submersible, marine vehicle consists in making the operations safe, both from the point of view of workers required to work thereon and from the point of view of the equipment.

Prior to the recovery of a vessel from a surface ship, the vessel and the surface ship are two moving bodies which react to different stresses and therefore exhibit movements that are different and not controllable on the sea. As long as they are at a distance from one another, they constitute masses which do not risk colliding with one another. The risk of a collision between these two masses is significant, in particular in rough seas, when a connection is intended to be established between these two masses. One solution for limiting the risk of a collision, when these two masses are intended to be connected together, is to provide mechanical decoupling between these two masses in order to limit the transmission of movements from one to the other. This makes it possible to ensure relative safety during the recovery of the vessel in rough seas.

An example of a device for making the recovery of a vessel from a surface ship relatively safe is disclosed in the French patent application filed by the applicant under the publication number FR3062844. That device comprises a gondola intended to support the vessel to be recovered. The gondola is connected to a rail that is fixed to the host ship and extends vertically in calm seas. The connecting means between the gondola and the rail make it possible to ensure freedom of movement of the cradle in pitch, yaw, roll and heave. The device comprises a lifting device comprising an upper frame situated above the cradle and connected to the gondola by hangers, the length of which is adjusted by winches. The gondola can be hoisted, by being moved in translation along the rail, from a position in which it floats on the surface of the water to a high part of the rail that is situated above the main deck of the host ship.

The hangers are flexible elements which allow relative movement between the gondola and the host ship while forming a permanent connection between the gondola and the host ship. During the hoisting of the vessel to be recovered, once it is supported by the gondola and connected to the rail, the reduction in the length of the hangers allows the vessel to be recovered to gradually take on the movements of the host ship. The vessel to be recovered can then be rigidly fixed to the host ship with limited risks of impacts between these two opposing masses.

However, in rough seas, when the assembly formed by the gondola and the vessel to be recovered arrives above sea level, this assembly risks swaying wildly since it is no longer damped by the water. Stop elements are provided to restrict the yaw movements of the assembly, but these stops constitute masses with which the assembly may collide, entailing risks of physical damage.

Furthermore, in the patent application FR3062844, the gondola may either float, making it possible only to recover surface vessels, or sink, making it possible to recover underwater vessels and surface vessels, but with a significant risk of the vessel N striking the gondola.

SUMMARY OF THE INVENTION

It is an aim of the invention to limit at least one of the abovementioned drawbacks.

To this end, a subject of the invention is a device for recovering a vessel at sea from a surface station, the recovery device comprising:

- a cradle intended to support the vessel,
- a lifting device comprising an upper frame and a set of hangers connecting the cradle to the upper frame, lengths of the hangers being variable so as to make it possible to hoist and lower the cradle,
- the set of hangers comprising a first stabilizing hanger and a second stabilizing hanger that are able to be in a stabilizing configuration in which the first stabilizing hanger and the second stabilizing hanger are under tension and extend linearly, and in which a first orthogonal projection of the first stabilizing hanger on a transverse plane defined by an axis z, which is linked to the upper frame and extends substantially vertically in calm seas, and by an axis y orthogonal to the axis z, and a second orthogonal projection of the second stabilizing hanger on the transverse plane are inclined with respect to one another so as to make it possible to limit swaying of the cradle with respect to the upper frame.

Advantageously, the vessel is intended to rest on the cradle under the effect of gravity while it is being hoisted.

Advantageously, the device comprises an attachment connecting a first attachment point of the cradle to a second attachment point that is fixed, in the receiving configuration, with respect to the upper frame in translation along the axis y and/or along an axis x orthogonal to the axis y and to the axis z.

In one particular embodiment, the device comprises:

- a connecting piece connected to the cradle with three degrees of freedom of rotation,
- a guide for guiding the connecting piece in translation along the axis z, with respect to the upper frame, during a variation in length of the hangers.

In particular embodiments, the connecting piece is connected to the cradle by a ball joint connection or a connection with three degrees of freedom of rotation and one degree of freedom of movement in translation along an axis parallel to an axis x linked to the upper frame and perpendicular to the axis y and to the axis z.

Advantageously, the recovery device is configured to recover a vessel moving on the surface of the water, for example, toward the connecting piece, in calm seas, preferably along an axis of forward movement parallel to an axis x linked to the upper frame and perpendicular to the axis y and to the axis z.

In one preferred embodiment, the first orthogonal projection and the second orthogonal projection cross one another.

Advantageously, the first stabilizing hanger and the second stabilizing hanger are able to be in a rest configuration in which the first stabilizing hanger and the second stabilizing hanger are under tension and in which a third orthogonal projection of the first stabilizing hanger on the transverse plane and a fourth orthogonal projection of the second stabilizing hanger on the transverse plane exhibit a smaller inclination with respect to one another than in the stabilizing configuration, such that swaying of the cradle with respect to the upper frame is more limited when the hangers are in the stabilizing configuration than when they are in the rest configuration.

Advantageously, the set of hangers comprises hoisting hangers disposed so as to make it possible to hoist the cradle with zero list in calm seas and to adjust an attitude of the cradle, each hoisting hanger having an orthogonal projection on the plane that is able to exhibit a single predetermined orientation in calm seas, when the hoisting hanger is under tension and extends linearly.

Advantageously, the device comprises means for adjusting the lengths of the hangers, said means being configured to keep the hangers of the set of hangers substantially under tension during a stabilized hoisting step during which the adjusting means hoist the cradle toward the upper frame, the recovery device being in the recovery configuration and the stabilizing hangers being in the stabilizing configuration.

Advantageously, the adjusting means are configured to keep the hangers of the set of hangers under tension during the stabilized hoisting step.

Advantageously, the adjusting means are configured to continuously reduce the lengths of the hangers of the set of hangers during the stabilized hoisting step.

Advantageously, the device comprises connecting means for connecting a bow of the vessel to the cradle so as to prevent the vessel from moving forward along the axis x with respect to the cradle.

The invention also relates to a method for stabilizing a cradle of a recovery device according to the invention, during which the hangers of the set of hangers are kept substantially under tension, the stabilizing hangers being in the stabilizing configuration.

The invention also relates to a method for hoisting a vessel at sea using a recovery device according to the invention. The hoisting method comprises a stabilized hoisting step during which the cradle is hoisted toward the upper frame under the effect of a variation in length of the hangers, the recovery device being in the recovery configuration and the stabilizing hangers being in the stabilizing configuration.

The proposed solution makes it possible to limit the relative swaying between the cradle and the surface platform. It makes it possible to limit the risks of collision between the vessel to be recovered and the surface platform while being lightweight and not being very bulky.

BRIEF DESCRIPTION OF THE DRAWINGS

Further features, details and advantages of the invention will become apparent from reading the description given with reference to the appended drawings, which are given by way of example and in which, respectively.

From one figure to another, the same elements are provided with the same references.

DETAILED DESCRIPTION

The invention relates to a device for recovering a self-propelled vessel, that is to say a vessel comprising propulsion means, from a surface station on which the recovery device is mounted. The surface station may be a surface ship, as in the nonlimiting example in the figures.

The surface station is, for example, in a variant, a station that is fixed with respect to the land, for example a dock of a seaport.

The invention applies, for example, to the recovery of autonomous vehicles or remote-controlled vehicles.

The vessel to be recovered is, for example, a self-propelled surface vessel, for example a USV (acronym for "Unmanned Surface Vehicle") or a submersible vessel, for example of the UUV (acronym for "Unmanned Underwater Vehicle") type.

Figure 1:
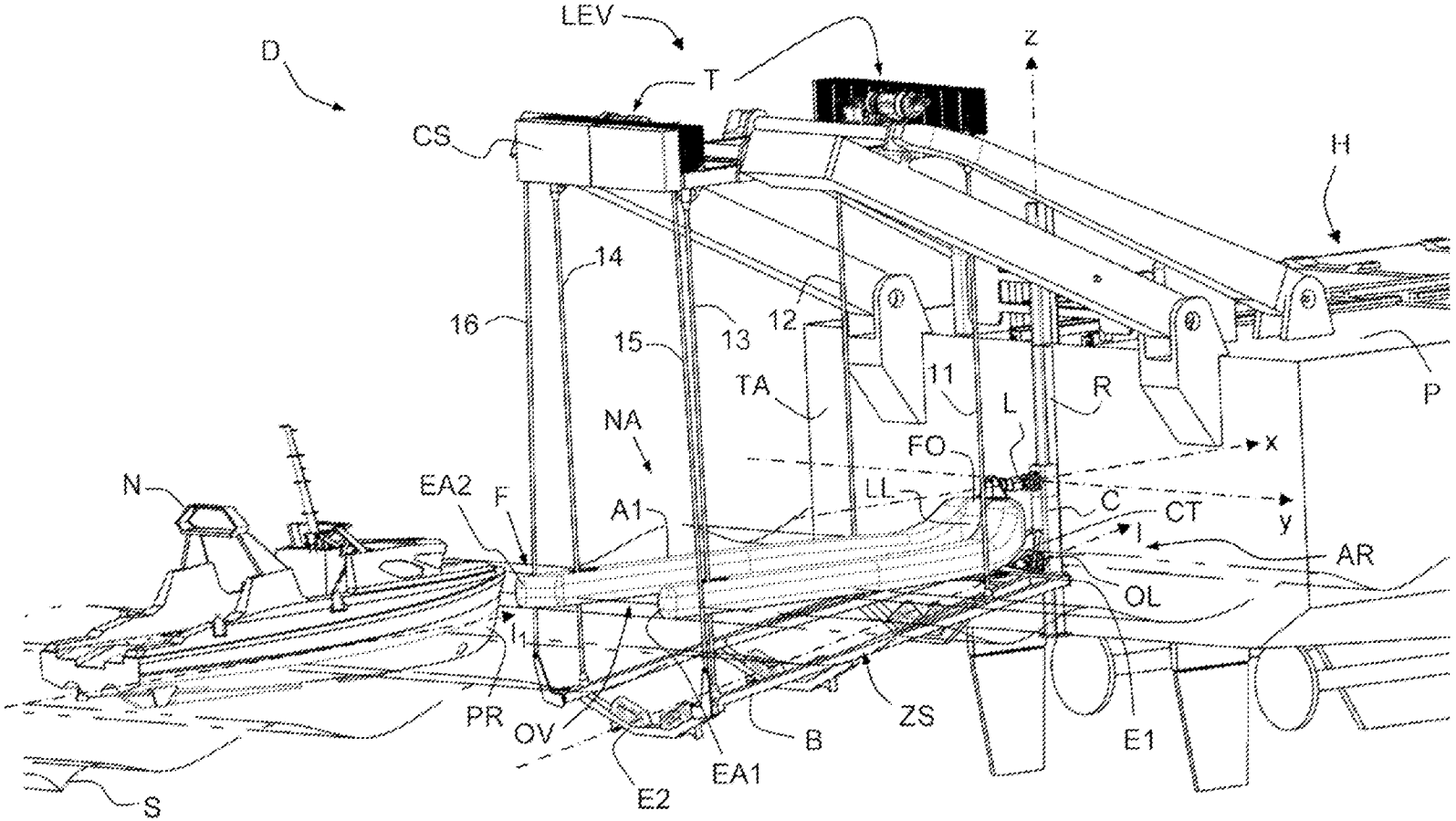
FIG. 1 is a schematic illustration of a device for recovering a vessel according to the invention in a receiving configuration, when the cradle is in a docking orientation, before receiving a vessel.

FIG. 1 schematically shows an example of a device D for recovering a submerged vessel N located at the surface S of the water (sea level), from a surface ship H, known as a host ship in the rest of the text. The device D is mounted on the host ship H.

As can be seen in FIG. 1, the device D comprises a gondola NA comprising a cradle B intended to support the vessel N so as to allow the vessel N to be hoisted under the hoisting effect of the cradle B.

Advantageously, the device is configured such that the vessel N is intended to rest on the cradle under the effect of gravity while it is being hoisted. The vessel N thus bears on the cradle B along the axis z.

The cradle B preferably exhibits negative buoyancy, making it possible to recover an underwater vessel N traveling under the water. In a variant, the cradle B exhibits positive buoyancy, making it possible only to recover a vessel N traveling on the surface. Zero buoyancy is also conceivable.

The recovery device is intended to hoist the cradle B, and therefore the vessel N resting on the cradle B, from sea level or from a fully submerged position situated below sea level, to a hoisted position in which the cradle B is situated above sea level next to the sea.

The hoisted position is, advantageously, a position situated above a platform of the surface station along a vertical axis so that it is possible to store the vessel N on the platform, from the hoisted position. In the example in the figures, the recovery device D is able to hoist the vessel N from sea level to a hoisted position with a height greater than the main deck P, of the host ship H, on which the vessel N is intended to be stored. The height of a point is defined along a vertical axis with respect to sea level. It is positive when the point is situated at sea level and negative when the point is situated below sea level.

In a variant, the platform is, for example, a platform on a dock of a seaport. Advantageously, but not necessarily, the recovery device is able to bring the vessel into a storage position on the deck of the vessel from the hoisted position, by moving the vessel N in translation along a horizontal axis in calm seas, as is described in the patent application FR3062844.

In order to make it possible to hoist the cradle B, the recovery device D comprises a lifting device LEV that is mounted on the host ship H and comprises an upper frame CS and a set of hangers 11 to 16 connecting the upper frame CS to the cradle B.

The recovery device D is able to be in a recovery configuration, as shown in FIGS. 1 to 11, in which the cradle B is situated next to the sea, the upper frame CS is fixed with respect to the host ship H and is next to the cradle B, and in which the hangers 11 to 16 connect the upper frame CS to the cradle B.

In this configuration, when the hangers are tensioned, the cradle B is suspended from the upper frame CS by the hangers 11 to 16.

The lengths of the hangers 11 to 16 are variable so as to make it possible to vary a distance of the cradle B with respect to the upper frame CS along a vertical axis by way of variations in the lengths of the hangers. Reducing the length of the hangers makes it possible to hoist the cradle B toward the upper frame CS. Increasing the length of the hangers makes it possible to lower the cradle B away from the upper frame CS.

The lifting device LEV makes it possible to hoist the cradle B from sea level or from a position in which the cradle B is fully submerged and below the surface of the water, to a hoisted position, when the device D is in the recovery configuration, under the effect of a variation in length of the hangers 11 to 16 of the assembly and more particularly under the effect of a reduction in their length.

The lifting device in the recovery configuration advantageously, but not necessarily, makes it possible to lower the vessel N from the hoisted position to sea level or to a fully submerged positions situated below sea level. The recovery device is then also a device for launching the vessel N. This is also achieved by varying the length of the hangers of the assembly and more particularly under the effect of an increase in the length of these hangers.

The device D also comprises means REG for adjusting the lengths of the hangers, which are configured to adjust the lengths of the hangers independently of one another.

Figure 2:
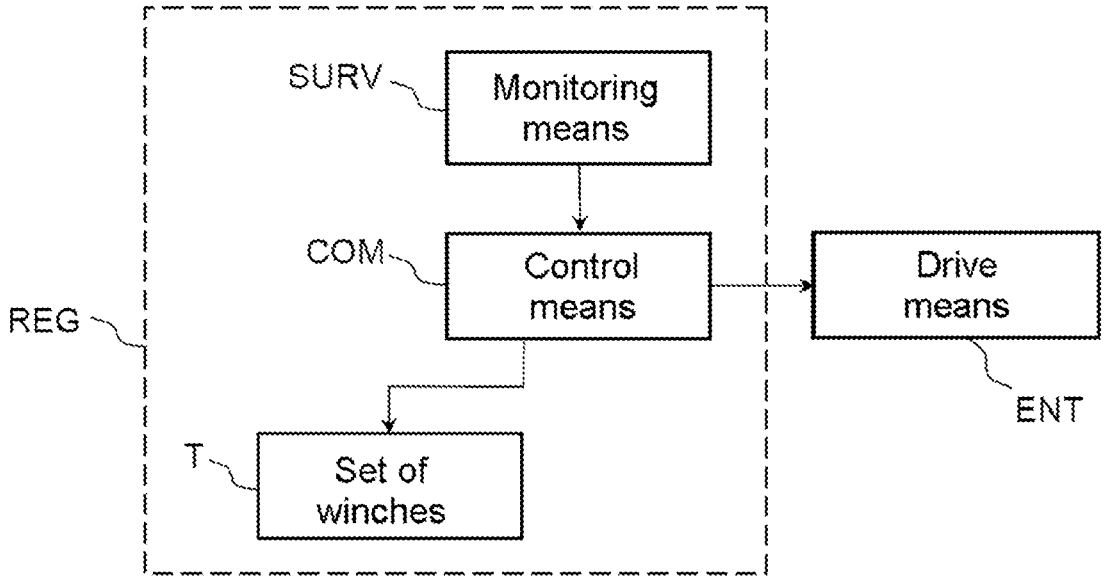
FIG. 2 is a block diagram of means of the recovery device according to the invention.

The adjusting means REG comprise a set T of motor-driven winches, as can be seen in FIG. 2, for varying the lengths of the hangers independently, and control means COM for controlling the winches of the set T of winches, as can be seen in FIG. 2.

The set T of winches comprises, for example, one winch per hanger, each winch being able to adjust the length of a single hanger. The winches of the set T are controllable independently of one another by means for controlling the winches.

In addition to the hangers, the recovery device comprises an attachment AR connecting a first attachment point CT of the cradle B to the host ship H permanently during the hoisting of the cradle B.

The attachment AR comprises a connecting member OL connecting the first attachment point CT of the cradle B to a second attachment point C, which is fixed, in the recovery configuration, with respect to the upper frame CS (that is to say with respect to the host ship H), in translation along an axis x and/or along an axis y that are linked to the upper frame CS and horizontal in calm seas, such that the first attachment point CT is connected with at least three degrees of freedom to the second attachment point C. Thus, the connecting member links the cradle B flexibly to the host ship H. The cradle B is made to sway about the second attachment point C in heavy seas.

The vertical direction is defined by the force of gravity. This direction is perpendicular to the surface of the sea in calm seas. The surface of the sea, in calm seas, defines the horizontal plane. The sea state is defined on the Douglas scale. Calm sea corresponds to zero force sea.

The first attachment point CT is a front region of the cradle B along the axis x, in the nonlimiting embodiment in the figures.

In this case, the second attachment point C is, for example, situated behind the first attachment point CT along the axis x.

In the nonlimiting example in the figures, the first attachment point is a central point of a longitudinal end E1 of the cradle B. In other words, the first attachment point CT is situated substantially at the center of the front end E1 of the cradle B, along the axis y in calm seas.

In the nonlimiting example in the figures, the attachment AR comprises a connecting member OL linking the first attachment point CT to a first attachment point C which is a connecting piece C such that the connecting piece C is connected to the cradle B with three degrees of freedom of rotation.

The connecting piece C is connected to a guide R that is fixed to the host ship H, that is to say to the frame CS, and makes it possible to guide the connecting piece C in translation along an axis z, with respect to the upper frame CS, during a variation in length of the hangers, when the recovery device is in the recovery configuration.

In the nonlimiting example in FIG. 1, the guide R is in the form of an elongate rail R along a longitudinal axis, which is the axis z. The connecting piece C is connected to the cradle B with three degrees of freedom of rotation and slidingly connected to the rail R along the axis z by way. The connecting piece C is connected to the cradle B, allowing these degrees of freedom of movement, by way of a connecting member OL. The rail R is fixed with respect to the host ship H when the recovery device D is in the recovery configuration and disposed such that the axis z extends substantially vertically in calm seas. The cradle B is then connected to the host ship H by way of the rail R and the connecting piece C.

Thus, the cradle B is connected to the host ship H (or the upper frame CS) with one degree of freedom of movement in translation along the axis z, and to the host ship H (or the upper frame CS) with three degrees of freedom of rotation.

As shown above, the degree of freedom of movement in translation along the axis z makes it possible to move the cradle B in translation, with respect to the host ship H and with respect to the upper frame CS, along the axis z. The three degrees of freedom of rotation ensure a certain decoupling of the movements of the cradle B from those of the host ship H. Thus, when the vessel N rests on the cradle B, the risks of impacts between the vessel N and the host ship H, in heavy seas, are limited, while the recovery device D ensures a continuous connection between the host ship H and the vessel N. The relative movements between the vessel N and the host ship H can thus be limited gradually without collision.

The recovery device D also comprises connecting means for connecting a bow PR of the vessel N to the cradle B so as to prevent the vessel N from moving forward along the axis x with respect to the cradle B.

Figure 5:
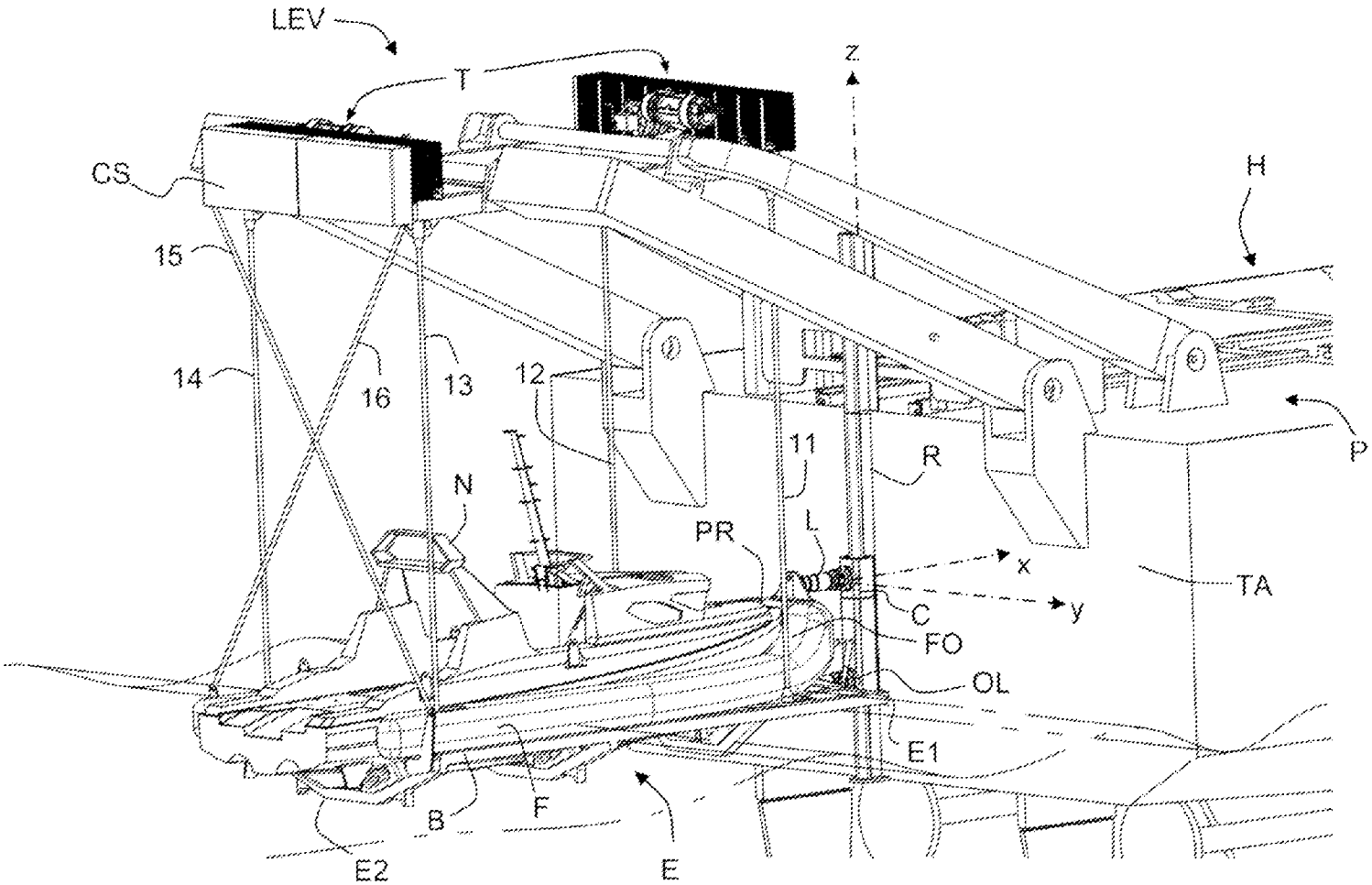
FIG. 5 is a schematic illustration of the device for recovering a vessel according to the invention, in the receiving configuration, when the cradle is in a hoisting orientation, after receiving a vessel, the stabilizing hangers being in a stabilizing configuration.

In order to make the hoisting of the vessel N safe when the latter is supported by the cradle B and connected to the host ship H, the set of hangers of the device D comprises, according to the invention, stabilizing hangers 15, 16, which are able to be in a stabilizing configuration, visible in FIG. 5, in which they are under tension, in which they extend linearly and in which their orthogonal projections on a transverse plane (y, z) that is linked to the upper frame CS, and therefore to the host ship H, and defined by the axis y and the axis z, are inclined with respect to one another. In other words, the first orthogonal projection of the first stabilizing hanger 15 on the transverse plane (y, z) is inclined with respect to the second orthogonal projection of the second stabilizing hanger on the transverse plane (y, z). In the stabilizing configuration, the stabilizing hangers limit the swaying of the cradle B with respect to the host ship H, in particular the component thereof about the axis z.

This limiting of swaying is particularly advantageous when the cradle B is out of the water.

It should be noted that "the hangers extend linearly" means that the hangers extend longitudinally along a single straight line.

In the advantageous embodiment in the figures, the stabilizing hangers 15, 16 are able to be in a stabilizing configuration in which the first orthogonal projection of the first stabilizing hanger 15 on the transverse plane (y, z) crosses the second orthogonal projection of the second stabilizing hanger on the transverse plane (y, z). The stabilizing hangers 15, 16 thus make it possible to ensure effective limiting of the swaying of the cradle B with respect to the host ship H while taking up a small volume.

In the nonlimiting embodiment in the figures, the recovery device is configured to recover, at sea, a vessel N moving, on the sea, for example toward the connecting piece C, in calm seas, preferably or substantially along an axis of forward movement parallel to an axis x, shown in FIG. 1, linked to the upper frame CS and perpendicular to the axis z. The direction of movement parallel to the axis x is defined as being the movement from the rear to the front.

For example, the cradle B extends longitudinally along a longitudinal axis I of the cradle B, from the front end E1 of the cradle B to a rear end E2 of the cradle B, and the axis I is able to be substantially parallel to the axis x, in calm seas, when the recovery device is in the recovery configuration. The front end E1 is situated in front of the rear end E2 along the axis x.

In a variant, the cradle B has substantially identical dimensions along the axis x and the axis y in calm seas when the axis I is substantially horizontal. In another variant, the dimension of the cradle B along the axis x is less than the dimension of the cradle B along the axis y in calm seas when the axis I is substantially horizontal.

The cradle B has, advantageously but not necessarily, the overall shape of a vessel hull, which is open and intended to substantially match the shape of the vessel N when the latter rests on the cradle B so as to prevent the transverse movements of the vessel N with respect to the cradle B. The transverse movements are movements of the vessel N along the axis y in calm seas. The axis y is perpendicular to x and z. This makes it possible to ensure a substantially fixed position of the vessel N with respect to the cradle B when the vessel N rests on the cradle B during the hoisting of the cradle B, in particular in calm seas.

In the case of recovery from the host ship H, the recovery device D is advantageously mounted on the host ship H such that the axis x is parallel to a main axis of movement p along which the host ship H is intended mainly to move. The axis p extends in the direction from the rear to the front of the host ship H. It is generally, but not necessarily, a longitudinal axis of the host ship H along which the host ship H extends longitudinally.

The receiving device D is, advantageously, mounted on the host ship H such that the cradle B or its support region ZS, in which the cradle B is intended to support the vessel N, extends entirely behind a transom TA of the host ship H when the receiving device is in the recovery configuration. This makes it possible to recover the vessel N from the rear of the host ship H.

In a variant, the receiving device D is mounted on the host ship H such that the cradle B is disposed on one side of the host ship H, that is to say to the side of the host ship H, along the axis y. The receiving device D then makes it possible to recover a vessel N moving parallel to the main axis p and arriving next to the host ship H along the axis y.

The manner of operation of the recovery device according to the invention and the associated recovery method will now be described in more detail.

Figure 3:
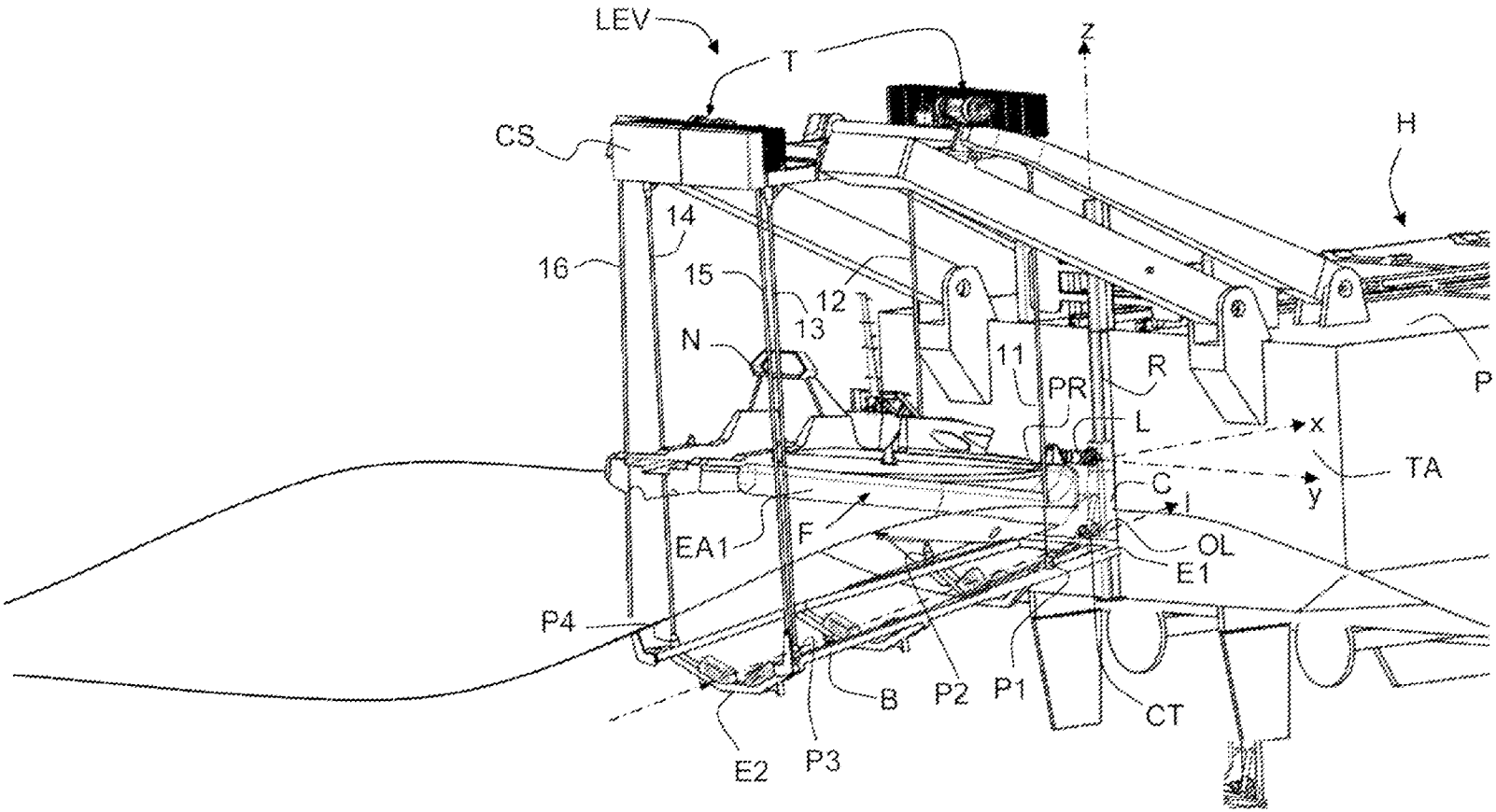
FIG. 3 is a schematic illustration of the device for recovering a vessel according to the invention in the receiving configuration, when the cradle is in a docking orientation, before receiving a vessel.

In FIG. 3, the device D is depicted schematically during a docking phase of the vessel N, during which the vessel N is positioned above the cradle B, between the cradle B and the upper frame CS.

During the docking phase of the vessel N, the stabilizing hangers 15, 16 are advantageously kept in a rest configuration, shown in FIG. 3, in which the stabilizing hangers 15, 16 are tensioned and substantially mutually parallel, meaning, more generally, in which a third orthogonal projection of the first hanger is substantially parallel to the orthogonal projection of the second hanger on the transverse plane (y, z) and spaced apart therefrom along the axis y. This possibility for the stabilizing hangers 15, 16 to be in the rest configuration makes it possible not to impair the vessel N in its movement along the axis x toward the guide R.

In a docking orientation as shown in FIG. 3, the cradle B has a positive attitude. In other words, in the docking orientation, the rear end E2 of the cradle B is situated at a lower height than the end E1. In other words, the end E2 is situated at a greater depth than the end E1. This docking orientation makes it possible for the arrival of the vessel N next to the cradle B, above the cradle B, to be easier and safer when the vessel N moves along the axis x. Specifically, this docking orientation moves the cradle B away from the volume into which the AUV will pass to be next to the cradle B, thereby making it possible to limit the risks of impacts and friction between the vessel N and the cradle B during this operation. The risks of the vessel N being damaged are thus limited.

When the vessel N arrives in abutment against a stop FO, which will be described below, situated in front of the vessel N along the axis x, the connecting means connect the bow PR of the vessel N to the cradle B so as to prevent the vessel N from moving forward along an axis x with respect to the cradle B.

The lifting device LEV comprises a set of hangers 11 to 16 comprising hoisting hangers 11 to 14 and the stabilizing hangers 15, 16.

The hangers 11 to 16 are disposed and connected to the cradle B so as to make it possible to hoist the cradle B with zero list, the cradle B then being substantially symmetric with respect to a vertical plane passing through the axis I, in calm seas, and so as to make it possible to vary an attitude of the cradle B by adjusting the lengths of the hangers.

In order to make it possible to adjust the attitude of the cradle B, the set of hangers comprises at least two hangers connected to the cradle B so as to exert respective vertical pulls on the cradle B at respective points that are spaced apart along the axis I or, more generally, along the axis connecting the ends E1 and E2 of the cradle B. This arrangement makes it possible to pass the cradle B from the docking orientation in FIG. 3 into a hoisting orientation, in FIG. 4, in which the cradle B exhibits a zero attitude in calm seas.

In order to make it possible to hoist the cradle B with zero list, in calm seas, the set of hangers 11 to 16 comprises at least two hangers connected to the cradle B so as to exert respective vertical pulls on the cradle B at respective points that are spaced apart along the axis y in calm seas.

Advantageously, the hoisting hangers are configured in these two latter ways. In a variant, all of the hangers, including the stabilizing hangers, are configured in these two latter ways, and the number of hangers can then be lower.

In the nonlimiting example in the figures, the set of hangers comprises two pairs of hoisting hangers 11, 12 and 13, 14.

The hangers 11 and 12 of the first pair of hangers exert vertical pulls on the cradle B at points P1 and P2, respectively, visible in FIG. 3, which are situated in the vicinity of the end E1, substantially at the same distance from the end E1. The hangers 13 and 14 of the second pair of hangers exert vertical pulling forces on the cradle B at points P3 and P4, visible in FIG. 1, which are situated in the vicinity of the end E2, substantially at the same distance from the end E2. The two hangers of each pair of hoisting hangers 11 and 12 (and 13 and 14, respectively) exert vertical pulls on the cradle B at points P1 and P2 (and P3 and P4, respectively) that are spaced apart along the axis y in calm seas, disposed on either side of the plane x, z passing through the connecting piece C in calm seas. Advantageously, P1 and P2 (and P3 and P4, respectively) are separated, in calm seas, by a plane parallel to the axes x and z passing through the connecting piece C.

Figure 4:
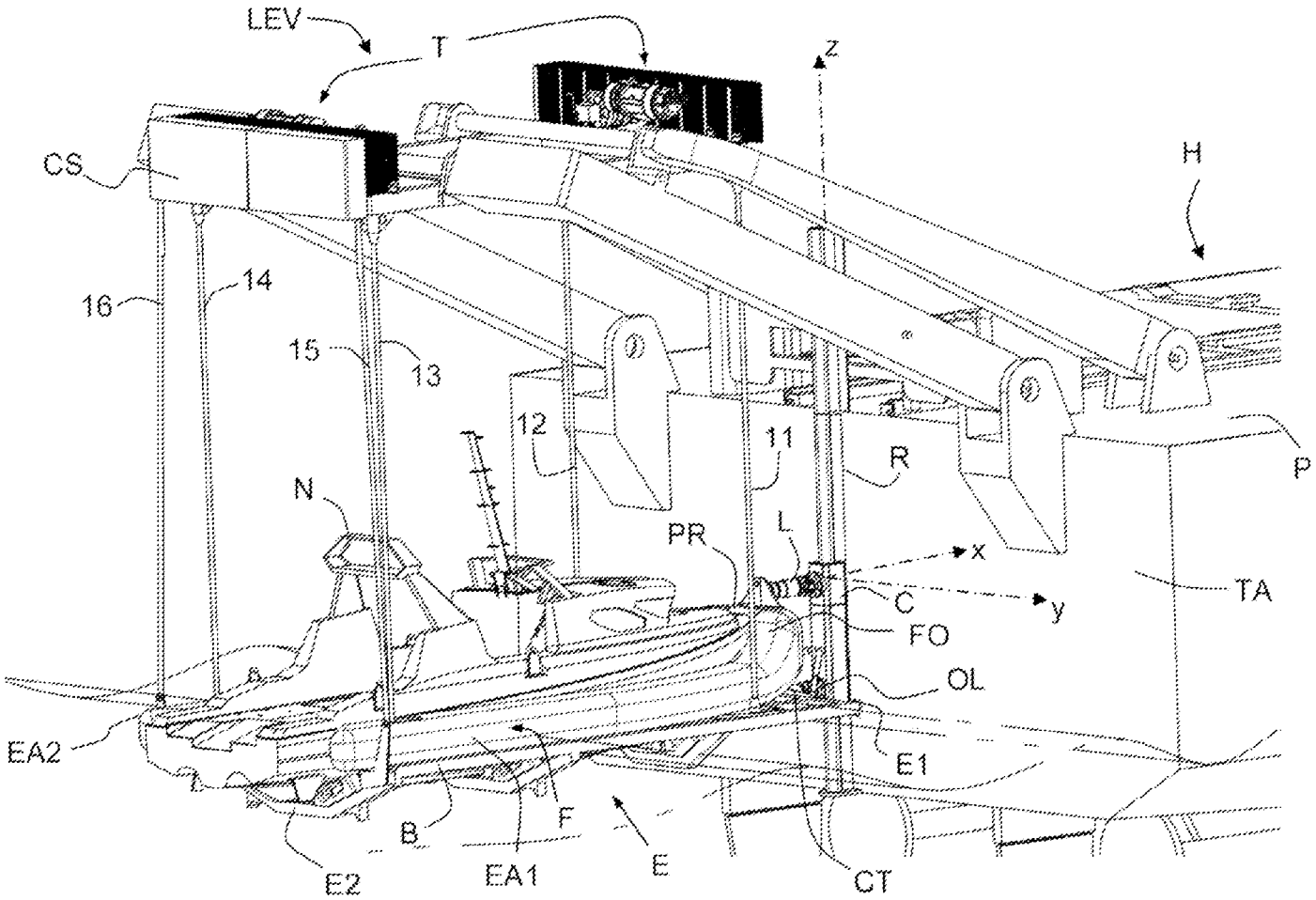
FIG. 4 is a schematic illustration of the device for recovering a vessel according to the invention in the receiving configuration, when the cradle is in a hoisting orientation, after receiving a vessel.

In order to pass the cradle B from the docking orientation in FIG. 3 to the hoisting orientation in FIG. 4, the length of the hangers 13 and 14 and preferably 13 to 16 is reduced.

The vessel N comes to rest on the cradle B so as to exhibit a substantially fixed position with respect to the cradle B.

The length of the hangers of the set is then reduced so as to hoist the cradle B into its hoisting orientation by sliding along the axis z.

The movements of the vessel N start to be controlled by the hangers 11 to 16 on account of the vertical pull that they exert on the cradle B. The assembly E formed by the cradle B and the vessel N connected to the cradle B and resting on the cradle B can still sway with respect to the host ship H under the effect of the waves, on account of the connection exhibiting three degrees of freedom of rotation, this ensuring that the connection has a certain flexibility.

When the assembly E arrives above the surface of the water, the swaying of the cradle B with respect to the host ship H is no longer damped and can even be amplified by resonance.

In order to limit the swaying of the assembly E with respect to the host ship, during hoisting, in particular the component thereof about the axis z, the stabilizing hangers 15 and 16 are put into the stabilizing configuration, as shown in FIG. 5.

Figure 6:
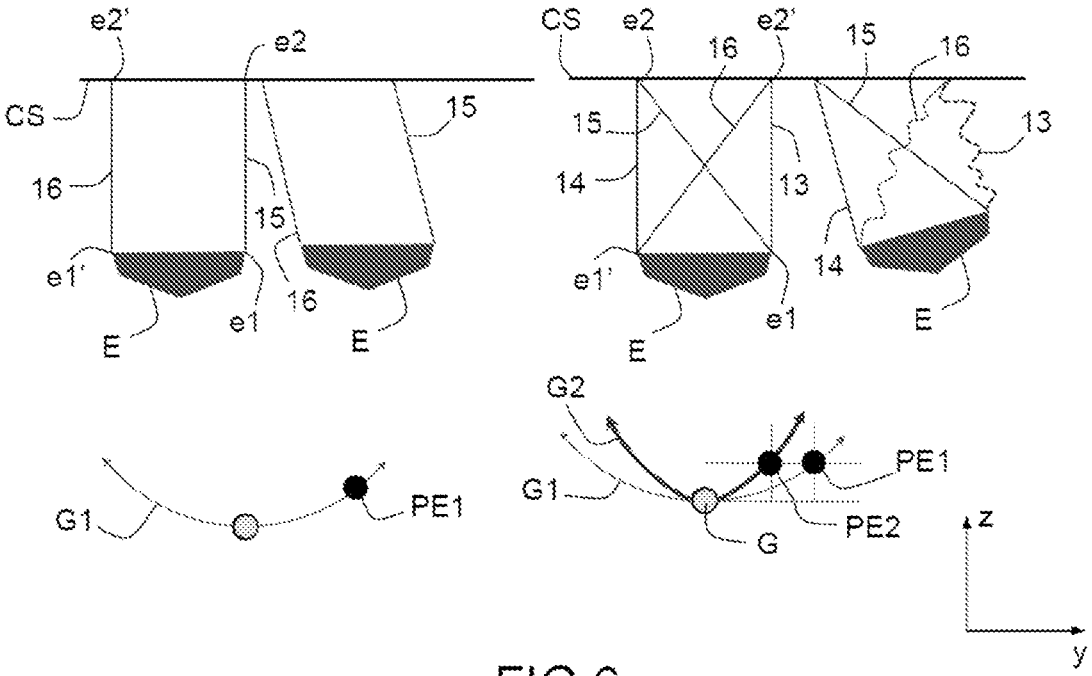
FIG. 6 illustrates the swaying of an assembly formed by the cradle and the vessel resting on the cradle, when the stabilizing hangers are mutually parallel (on the left) and when their projections on a plane (y, z) cross one another (on the right), FIG. 7 schematically shows successive views a to f, in the plane y, z, of the hoisting of the assembly formed by the vessel and the cradle by placing the hangers back under tension, which become slack under the effect of the swaying of the assembly with respect to the host ship, FIG. 8 schematically shows a perspective view of the swaying of the assembly with respect to the host ship, FIG. 9 schematically shows projections of the stabilizing hangers in the stabilizing configuration on the plane y, z.
Figure 7:
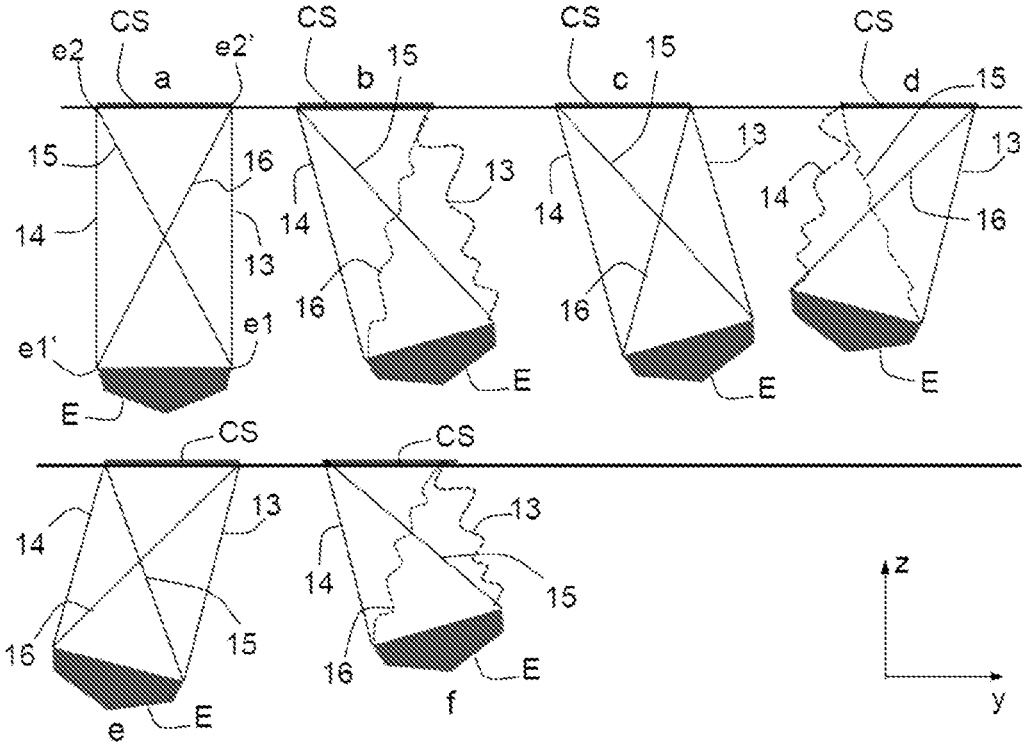

To this end, as can be seen in FIGS. 6 and 7, the stabilizing hangers 15, 16 each comprise, for example, a first longitudinal end e1, e1' fixed to the cradle B and a second longitudinal end e2, e2' connected to the upper frame CS. The lifting device LEV comprises drive means ENT, referenced in FIG. 2, for passing the stabilizing hangers 15 and 16 from the rest configuration to the stabilizing configuration by moving the two ends e2, e2' of each of the stabilizing hangers 15, 16 in the opposite direction along the axis y in order to put the stabilizing hangers 15, 16 into the stabilizing configuration in FIG. 5. The second end e2, e2' of each stabilizing hanger 15, 16 is moved, getting closer, along the axis y, to the position taken up by the second end e2', e2 of the other stabilizing hanger in the rest configuration.

As can be seen in FIG. 2, control means COM are able to control the drive means ENT.

By putting the stabilizing hangers 15, 16 in the stabilizing configuration, the swaying of the assembly E with respect to the host ship H is limited. Specifically, when the orthogonal projections of the stabilizing hangers 15, 16 on the plane (y, z) cross one another or, more generally, when they are inclined with respect to one another, it is more difficult for the center of gravity of the assembly E to move. As shown in FIG. 6, on the left, when the stabilizing hangers 15, 16 are mutually parallel, or in the absence of stabilizing hangers, the center of gravity G of the assembly E moves over a first trough G1 in a transverse plane parallel to (y, z) as far as an extreme position PE1. The cradle B which is connected to the rail R at the front, by a connection with three degrees of freedom of rotation, undergoes swaying, which is a combination of the movements about the three axes and in particular about the axis z. When the projections of the tensioned stabilizing hangers 15, 16 are inclined with respect to one another, the center of gravity of the assembly moves over a second trough G2, shown in FIG. 6 on the right, having steeper slopes than those of the first trough G1, as far as a second end position PE2. This phenomenon is accentuated as the hoisting of the cradle B continues, the slopes of the trough over which the center of gravity can move becoming steeper. Thus, the recovery device D according to the invention makes it possible to make the swaying of the assembly E with respect to the rail R about the axis z tighter and tighter while hoisting continues. The constraints on the movement of the assembly E with respect to the host ship H increase slowly and gradually while avoiding the installation of a stop, which would limit its swaying but which could be struck by the vessel N with risks of the vessel N being damaged.

Furthermore, this solution does not require heavy or bulky dampers to damp the swaying movement of the assembly through energy dissipation. This solution is based on hangers which are lightweight and not very bulky.

This solution also makes it possible to benefit from the natural swaying of the cradle B with respect to the host ship H, under the effect of the waves, to make it easier to hoist the assembly E and to hoist the assembly E smoothly, benefiting from the alternate phases of tension and slack of the hangers. A particular configuration of the set T of winches and of the control means COM for the set of winches can be implemented to this end.

Specifically, when the cradle B is connected with three degrees of freedom of rotation to the rail R fixed to the host ship H, the relative swaying of the assembly E with respect to the host ship H is swaying about the x, y and z axes. This swaying comprises a component along the axis z, which causes certain hangers to slacken, as can be seen in view b in FIG. 7. However, this swaying, under the effect of the waves, occurs without any effort on the part of the winches T. Thus, by commanding the set T of winches to reinstate or maintain the tension, upon each sway of the assembly E with respect to the rail R, in the hangers which slacken or tend to slacken under the effect of the swaying of the assembly E, as can be seen in views c and e in FIG. 7, rather than leaving them slack or allowing them to slacken, as can be seen in views b, d and fin FIG. 7, the assembly E is hoisted while limiting the energy necessary for this hoisting. The swaying of the assembly E with respect to the host ship H is shown in perspective in FIG. 8.

The particular control described above makes it possible, furthermore, to halt the swaying of the assembly E. Specifically, by reinstating or maintaining the tension in the hangers which slacken or tend to slacken under the effect of the swaying of the assembly E in a first direction, this amounts to taking potential energy from the assembly E when the latter arrives in an extreme position in which its kinetic energy is zero. The energy of the assembly E at this end point is its potential energy. The reduction in the potential energy of the assembly E brings about a decrease in its total energy. This decrease in energy has the effect of reducing its maximum kinetic energy. Thus, the speed and amplitude of the swaying of the assembly E decrease progressively upon each sway.

Thus, the means REG for adjusting the lengths of the hangers are advantageously configured to keep the hangers 11 to 16 substantially tensioned, that is to say under tension permanently or at least during a phase of hoisting the cradle B or the assembly E that starts when the cradle B is submerged or at least during a phase of hoisting the cradle B or the assembly E that starts when the cradle B is out of the water.

Preferably, in order to avoid any slack of the hangers, which is likely to cause irregular winding of the filiform lines forming the hangers 11 to 16 onto the winches of the set T, the adjusting means REG are configured to keep the hangers 11 to 16 tensioned, that is to say under tension, permanently or at least during a phase of hoisting the cradle B that starts when the cradle B is submerged, or at least during a phase of hoisting the cradle B or the assembly E that starts when the cradle B is out of the water.

Preferably, the adjusting means REG are configured to keep each hanger under constant tension.

It should be noted that if only the natural swaying of the assembly E is used to hoist it, it is not possible to hoist the assembly E in calm seas since the assembly E does not sway with respect to the host ship H.

Advantageously, the adjusting means REG are configured to continuously reduce the length of each of the hangers 11 to 16 during a stabilized hoisting phase during which the stabilizing hangers are in the stabilizing configuration.

In other words, during the stabilized hoisting phase, the adjusting means REG are configured to keep the hangers 11 to 16 substantially under tension by increasing, for example, the speed of reduction of the lengths of the hangers which slacken or tend to slacken under the effect of the swaying of the cradle B with respect to the host ship H while continuing to reduce the lengths of the hangers which are tensioned under the effect of the swaying of the cradle B with respect to the host ship H.

For example, while, during the hoisting process, the adjusting means REG are configured to reduce the length of each hanger at a predetermined fixed speed of hoisting the hanger in question in the absence of swaying of the cradle B with respect to the rail R, the adjusting means are configured to reduce the length of each hanger which tends to be tensioned under the effect of the relative swaying of the cradle B and of the rail R at a higher speed than the predetermined speed and to reduce the length of each hanger which tends to slacken under the effect of the relative swaying of the cradle and of the rail R at a lower speed than the predetermined speed.

To this end, the adjusting means REG comprise, as can be seen in FIG. 2, means SURV for monitoring the tension in the hangers 11 to 16, making it possible to measure a physical quantity representative of the tensions in the hangers, that is to say the inclination of the cradle B with respect to the host ship H, for example about the axis z. These monitoring means SURV comprise, for example, an inclinometer for measuring an inclination of the hangers, an acceleration sensor, a first inertial unit for measuring an orientation of the cradle and/or a second inertial unit for measuring an orientation of the host ship H, at least one tension sensor, each tension sensor making it possible to measure the tension in a hanger. The orientation of the host ship and/or of the cradle may, in a variant, be measured using one or more acceleration sensors and/or one or more gyrometers that each make it possible to measure a component of an angular speed vector and/or using a position sensor.

The invention also relates to a method for stabilizing the cradle B or the assembly E, consisting in keeping the hangers 11 to 16 of the set of hangers substantially under tension, and preferably under tension, during relative swaying of the cradle B with respect to the host ship H, the recovery device being in the recovery configuration, the stabilizing method comprising a step of putting the stabilizing hangers from the rest configuration into the stabilizing configuration.

Advantageously, the stabilizing method is implemented when the cradle B extends above sea level, i.e. when its support region ZS extends above sea level.

The invention also relates to a method for hoisting the cradle B, or the assembly E, the recovery method comprising a stabilized hoisting step for the cradle B or the assembly E, for example from sea level, or from a higher or lower level, to a hoisted position situated above sea level, during which the hangers 11 to 16 are kept substantially under tension, and are preferably kept under tension, while the cradle B slides along the axis z toward the upper frame CS, the recovery device D being in the recovery configuration and the stabilizing hangers being in the stabilizing configuration.

When the hangers are able to pass from a rest configuration to the stabilizing configuration, the method comprises a placement step, prior to the stabilizing or stabilized hoisting step, consisting in putting the hangers in the stabilizing configuration.

Preferably, the hangers are in the stabilizing configuration throughout the hoisting step or until the end of the hoisting procedure, starting from the time at which the cradle B is situated above sea level (that is to say is out of the water) or from the time at which the cradle B is situated at the surface of the sea or from a position in which the cradle B is fully submerged.

Preferably, the hangers are kept under constant tension throughout the stabilized hoisting step and/or the stabilizing method.

Advantageously, during the stabilizing hoisting step, the length of each of the hangers 11 to 16 of the set is reduced continuously. In other words, the speed at which the length of each of the hangers is reduced is not zero and is positive during the hoisting step.

The method comprises, advantageously, a step in which the cradle is passed from a docking orientation to a rest orientation by adjustment of the lengths of the hangers. This step is before the stabilized hoisting step and preferably before the step in which the stabilizing hangers are put in the stabilizing configuration.

It should be noted that the inclination of the projections of the stabilizing hangers 15, 16 on the transverse plane (y, z) with respect to one another also makes it possible to limit the swaying of the cradle B with respect to the host ship H outside hoisting phases by configuring the adjusting means appropriately, in particular the component of swaying about the axis z.

In the nonlimiting example in the figures, the stabilizing hangers 15, 16 are connected to the cradle B so as each to exert a vertical pull on the cradle B, substantially at the end E2 of the cradle B.

In other words, more generally, the stabilizing hangers 15, 16 are connected to the cradle B so as each to exert a vertical pull on the cradle B at a distance from the first point along the axis x perpendicular to the plane (y, z) in calm seas and preferably substantially at an end farthest away from the first attachment point along the axis x perpendicular to the plane (y, z) in calm seas. This makes it possible to effectively limit the swaying of the cradle B with respect to the host ship.

In a variant, the stabilizing hangers 15, 16 each exert a vertical pull on the cradle B at a distance from the end E2 and from the end E1, along the axis I.

Figure 9:
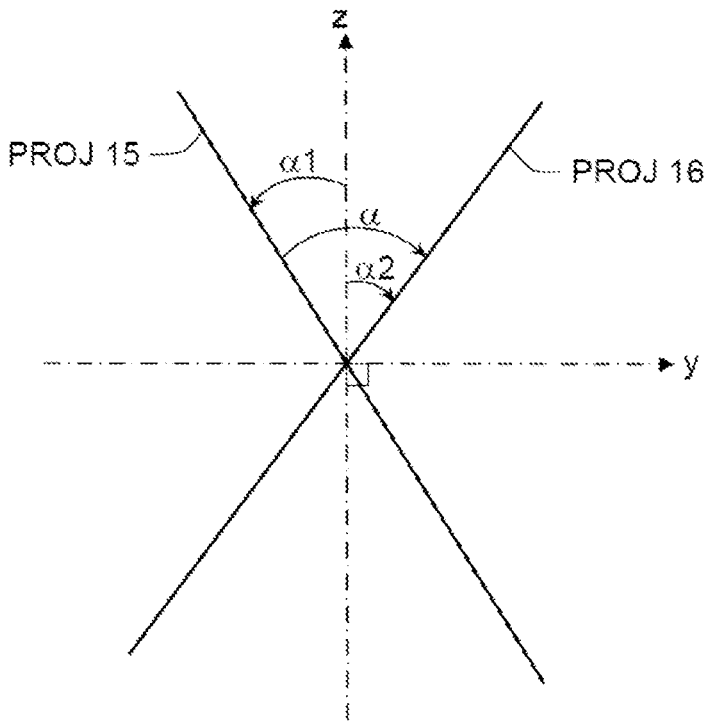

In the nonlimiting example in the figures, in the stabilizing configuration, the orthogonal projections PROJ15, PROJ16 of the stabilizing hangers 15 and 16, respectively, on the transverse plane (y, z), as shown schematically in FIG. 9, cross one another. They form an angle $\alpha$ between one another. This angle is the difference between the oriented angle $\alpha$1 formed by the orthogonal projection PROJ15 of the first stabilizing hanger 15, in the plane (y, z), with respect to the axis z, and the oriented angle $\alpha$2 formed by the orthogonal projection PROJ16 of the second stabilizing hanger 16, in the plane (y, z), with respect to the axis z.

In a variant, in order to pass the stabilizing hangers from the rest configuration into the stabilizing configuration, the second end of each stabilizing hanger is moved, along the axis y, toward the position taken up by the second end of the other stabilizing hanger in the rest configuration. This configuration requires an upper frame CS with a larger dimension along the axis y compared with the embodiment in the figures and has a negative effect on the compactness of the solution.

In a variant, the projections of the stabilizing hangers on the transverse plane (y, z) are inclined with respect to one another in the rest position. On passing from the rest configuration to the stabilizing configuration, the absolute value of the angle $\alpha$ formed between the projections PROJ15 and PROJ16 of the two hangers increases.

In a variant, in the stabilizing configuration, the orthogonal projections of the stabilizing hangers 15, 16 on the transverse plane (y, z) do not cross one another.

Advantageously, when the orthogonal projections of the stabilizing hangers do not cross one another in the stabilizing configuration, they are inclined in the opposite direction with respect to the axis z.

In another variant, the stabilizing hangers 15, 16 are only able to be in the stabilizing configuration. However, the stabilizing hangers can act as an obstacle to the passage of the vessel N to arrive next to the cradle. Furthermore, the projections of the stabilizing hangers do not cross one another in the stabilizing configuration, and the dimension of the upper frame CS along the axis y needs to be greater if there is a desire to achieve the same inclination between the projections of the hangers on the plane (y, z) as when these projections cross one another.

Figure 10:
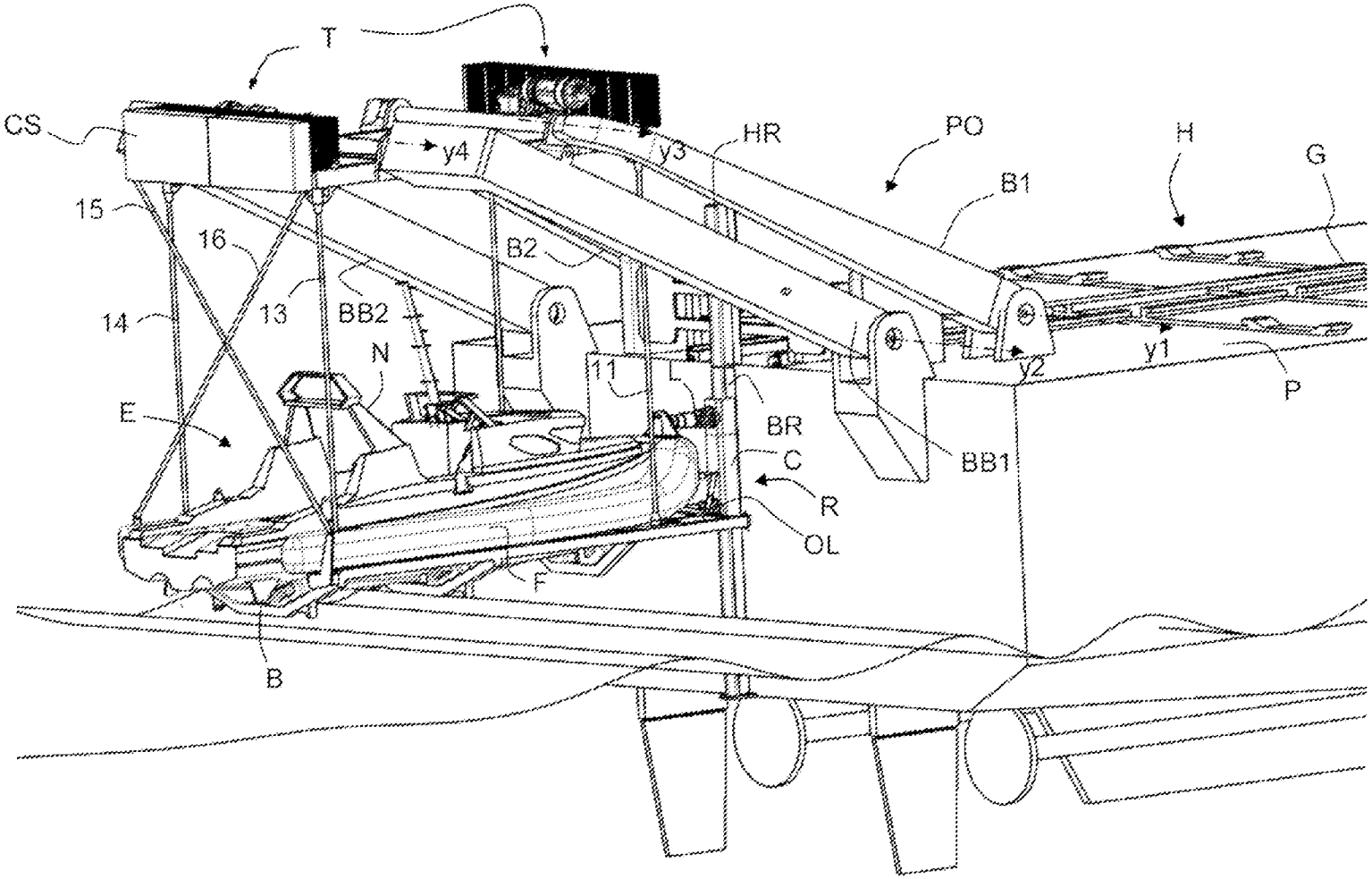
FIG. 10 is a schematic, perspective illustration of the device for recovering a vessel according to the invention, in the receiving configuration, when the cradle is in a hoisting orientation and the assembly is located above sea level.

In FIG. 10, the assembly E is at an intermediate height between sea level and the level of the deck P.

Figure 11:
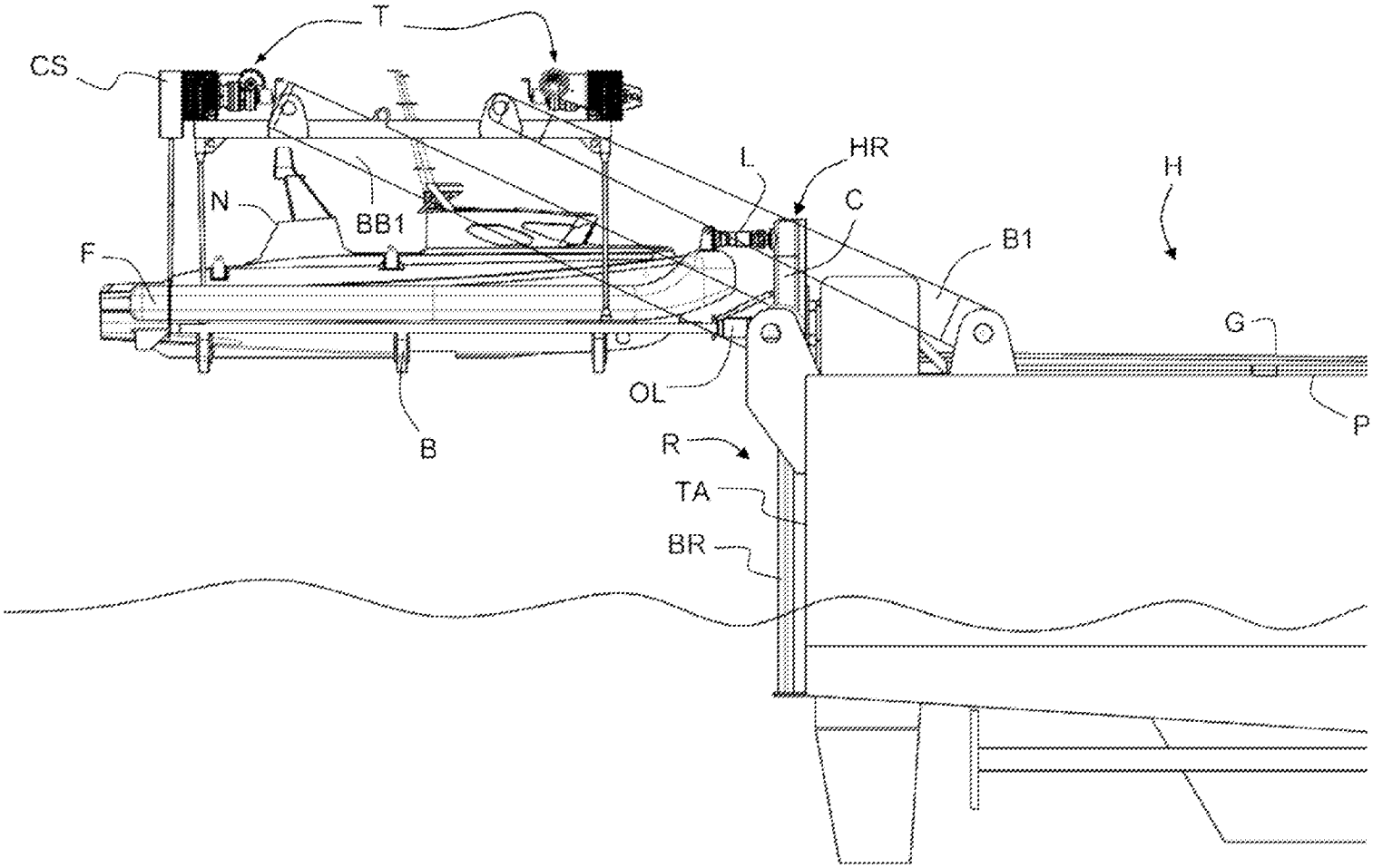
FIG. 11 is a schematic illustration, in side view, of the device for recovering a vessel according to the invention, in the receiving configuration, when the cradle is in a hoisting orientation and arrives at a top part of a guide rail.
Figure 12:
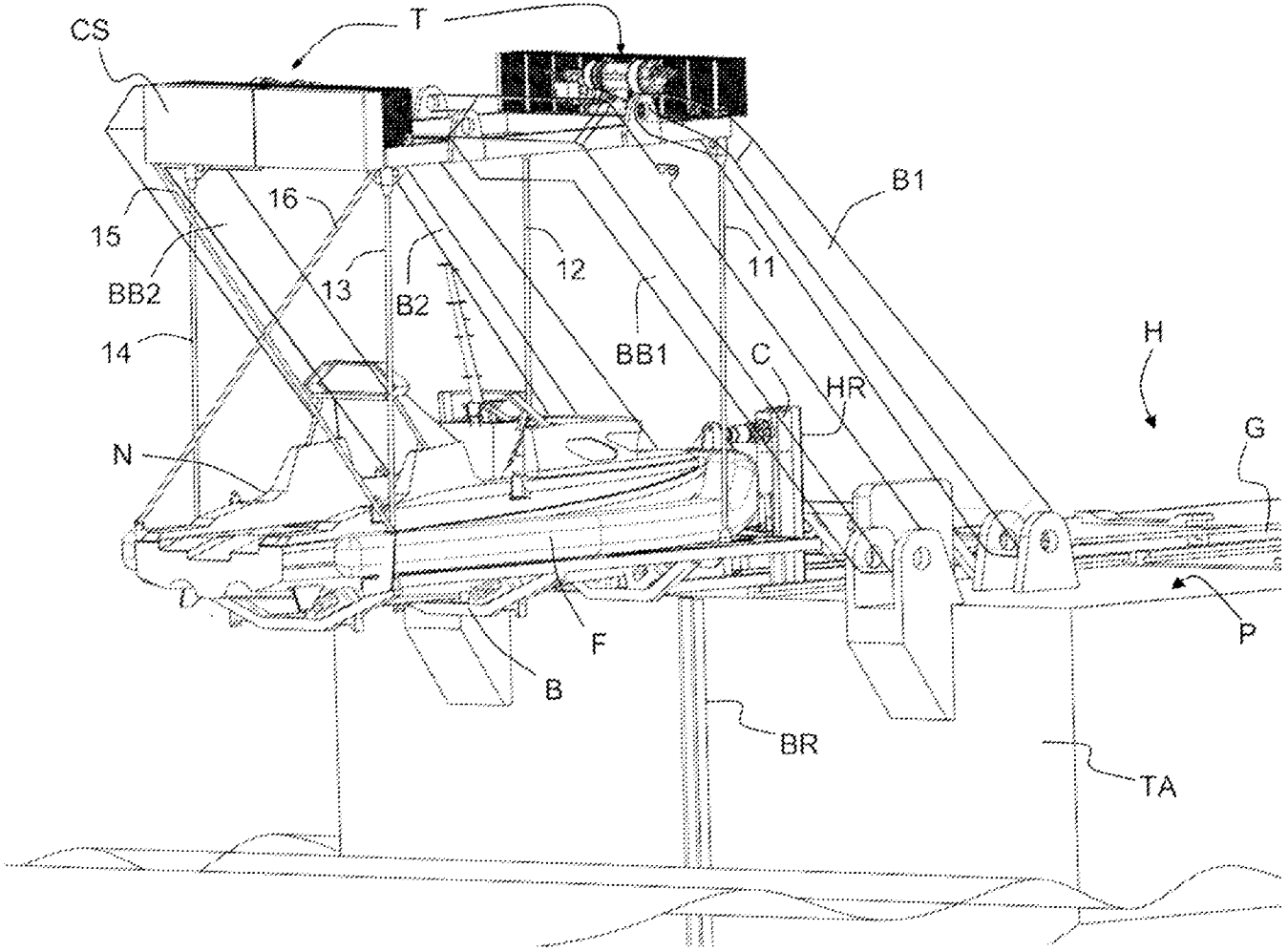
FIG. 12 is a schematic illustration, in side view, of the device for recovering a vessel according to the invention after the assembly has slid along a guide extending along the deck of the vessel.

Preferably, as can be seen in FIG. 10, the rail R comprises a bottom part BR situated below the freeboard of the host ship and a top part HR situated above the freeboard of the vessel. The top part HR of the rail is separable from its bottom part BR and is able to slide along a guide G, for example, along the axis x. Thus, when the assembly E has been hoisted in translation along the rail R as far as the hoisted position and therefore as far as the top part HR of the rail R, as can be seen in FIG. 11, the top part HR of the rail is detached from the bottom part BR and slides along the guide G, as can be seen in FIG. 12, to move the assembly E as far as a storage position in which the assembly E is entirely next to the deck P and rests on the deck P. Thus, the manipulated assembly E always remains in contact with the host ship H.

The upper frame CS is, for example, connected to the host ship H so as to be able to be moved from a receiving position, in which it is situated next to the deck of the vessel or the rail R, along the axis x to a storage position in which the upper frame CS is located above the deck P of the vessel. Preferably, the upper frame CS maintains its orientation about the three axes x, y, z with respect to the host ship H.

As can be seen in FIG. 10, the upper frame CS is, for example, connected to the host ship H by a gantry PO having double arms spaced apart symmetrically from one another with respect to the plane x, z. Each double arm comprises a first arm B1, B2 mounted so as to pivot with respect to the deck P of the host ship H about one and the same first individual axis y1 parallel to the axis y and a second individual arm BB1, BB2 with the same length as the first arm B1, B2 and mounted so as to pivot with respect to the deck P of the host ship H about one and the same second individual axis y2 parallel to the first individual axis y1 and spaced apart from the first individual axis y1 along the axis x. The upper frame CS is suspended from the individual arms and mounted so as to pivot on each of the individual arms B1, BB1; B2, BB2 about axes y3, y4 substantially parallel to the individual axes y1, y2. The upper frame CS is able to be moved from its receiving position to the storage position by each of the individual arms being pivoted about its individual axis while maintaining one and the same orientation with respect to the host ship H.

Each hanger 11 to 16 is a portion of a longer flexible filiform line that is able to be wound around one of the winches of the set T. A hanger is understood to be the part of the filiform line that extends from a first point on the upper frame CS to a second point on the cradle B, on each of which the filiform line exerts a pull when the hanger is tensioned, meaning that it extends linearly from this first point to this second point. In other words, these two points are the points on which the opposite traction forces are exerted that place the hanger under tension. These two points are the two ends of the hanger, i.e. the portion in question of the filiform line. The lengths of the hangers, i.e. the length of the portion of the filiform line forming the hanger, from the first point to the second point, is adjusted by winding the filiform line around a drum of a winch or by unwinding it from the drum. The length of the hangers is not intended to be adjusted by an extension of the filiform line. In other words, the filiform line is intended to have a substantially fixed length and the length of the hangers is intended to vary substantially only through a variation in the length of the filiform line from the first point to the second point.

The different hangers 11 to 16 can be formed by separate filiform lines or hangers of the assembly can be formed by one and the same filiform line.

In the example in the figures, the winches of the set T are mounted on the upper frame CS but could, in a variant, be mounted on the deck of the vessel or on the cradle B.

In the example in the figures, the set of hangers 11 to 16 comprises four hoisting hangers and two stabilizing hangers. In a variant, the set of hangers could comprise a different number of hoisting and/or stabilizing hangers as long as they make it possible to slide the cradle B along the rail R and keep its list zero and adjust its attitude.

Each hoisting hanger has, when the set of hoisting hangers is under tension, an orthogonal projection on the plane (x, y) that is able to exhibit a single predetermined orientation in calm seas.

Advantageously, the hoisting hangers 11 to 14 are disposed so as to be substantially parallel to one another when they are under tension. In a variant, at least one hoisting hanger 11 to 14 is inclined with respect to another hoisting hanger when they are under tension.

In the nonlimiting embodiment in the figures, the attachment AR comprises a member connecting the first attachment point CT of the cradle to a connecting piece C slidably connected to the upper frame CS, via the guide R, in the receiving configuration.

The first attachment point CT is connected to the connecting piece C with three degrees of freedom of rotation. Advantageously, the connecting member OL establishes a connection with six degrees of freedom (three movements in translation and three rotations) between the cradle B and the connecting piece C. In a variant, the piece C is connected to the cradle B by a ball joint connection or connected to the cradle B with three degrees of freedom of rotation and one or two degrees of freedom of movement in translation. Each degree of freedom of movement in translation allows a relative movement in translation between the piece C and the cradle B with a predetermined travel.

Advantageously, when the connecting piece C is connected to the cradle B with three degrees of freedom of rotation and one degree of freedom of movement in translation, the degree of freedom of translation movement is along the axis x.

This embodiment is in no way limiting.

In one variant, the cradle B is tethered to the host ship H by the first attachment point CT via a rope, that is to say to a second attachment point, which is fixed with respect to the upper frame CS in the receiving configuration, such that the first attachment point CT is connected with three degrees of freedom of rotation and three degrees of freedom of movement in translation with respect to the second attachment point.

In another embodiment, the device does not have an attachment.

Advantageously, as shown in the figures and as can be seen in FIG. 1, the gondola NA comprises a guide float F that is able to exhibit predetermined positive buoyancy. The float F is interposed between the cradle B and the upper frame CS such that the cradle B is intended to support the guide float F during the hoisting of the cradle B under the effect of a variation in length of the hangers 11 to 16.

The cradle B is located beneath the upper frame CS along a vertical axis or along the axis z in calm seas.

In other words, the guide float F is next to the cradle B and interposed between the cradle B and the upper frame CS along the axis z.

The float F is configured and connected to the cradle B so as to guide a vessel N moving on the surface of the water forward with a speed of movement comprising a positive component along an axis x toward a front part FO of the cradle B. The front part FO of the cradle B is the part of the float FO which is situated at the front of the float FO along the axis x in calm seas.

The front part FO of the float is, preferably, situated substantially next to the front end E1 of the cradle B or the support region ZS of the cradle B.

The guide float F is connected to the cradle B with at least three degrees of freedom of rotation.

This freedom allows the guide float F to move with respect to the cradle B. Thus, during the receiving step shown in FIG. 3, during which the cradle B, exhibiting negative buoyancy, is in the docking orientation, the float F remains on the surface S of the water. There is therefore a certain distance between the float F and the cradle B along the axis x, this distance increasing from the front to the rear of the float F. This distance makes it possible to ensure effective safety during the phase of receiving the vessel. It limits the risks of collisions between the vessel N and the cradle B, in particular the bottom part of the vessel N.

Advantageously, the guide float F is movable in translation along the axis z with respect to the cradle B, the axis z being vertical in calm seas. This makes it possible to limit the risks of impacts between the vessel N and the cradle B, the heavy cradle B being able to move away from the float F, when it is submerged, by moving in translation along the axis z with respect to the float F, lengthening the hangers as a result, thereby making it possible to leave free a larger volume, in particular with a greater depth for docking the vessel N.

The movement of the float F in translation with respect to the cradle B can be allowed with a predetermined maximum amplitude along the axis z or may be free.

Advantageously, the float F is connected with three degrees of freedom of movement in translation of the float F with respect to the cradle B.

Each movement in translation along an axis perpendicular to the axis z may be is, allowed with a predetermined maximum amplitude along this axis.

To this end, in the nonlimiting example in the figures, the float F is connected to the cradle B via the connecting piece C. The front FO of the float F is connected to the connecting piece C by a second connecting member L. The second connecting member L establishes a connection with six degrees of freedom (three movements in translation and three rotations) between the float F and the connecting piece C and allows each of these movements, freely or with a predetermined maximum amplitude. In a variant, the float F is connected to the connecting piece C by a ball joint connection or connected thereto with three degrees of freedom of rotation and one or two degrees of freedom of movement in translation. This variant is less advantageous from the point of view of the risks of impacts between the vessel N and the float F.

In a variant, the float F is free to move in translation along the axis z with respect to the cradle B. In other words, it is able to slide along the axis z with respect to the frame, independently of the cradle B. This makes it possible, during the phase of receiving the vessel N, to leave a larger volume under the float, between the float and the cradle B, by making it possible to submerge the cradle B as deeply as desired.

For example, the float F is connected to the rail R via a second connecting piece slidably connected to the rail R. The second piece is separate from the first connecting piece so as to be able to slide along the rail R independently with respect to the cradle B.

In a variant, the float F is connected to the cradle B with three degrees of freedom of rotation and connected to the cradle B with no degree of freedom of movement in translation.

The recovery device D comprises a third connecting member LL for coupling the bow PR of the vessel N, also known as the nose of the vessel N in the case of submarines, to the float FO, preferably to the front FO of the float F, when the vessel N arrives next to the front FO of the float or in abutment with the front FO of the float F.

This third connecting member LL thus makes it possible to connect the vessel N to the host ship H, which then tows the vessel N.

The vessel N, coupled to the float F, is located next to the cradle B, with the bow P toward the front along the axis x.

The bow PR is situated substantially next to the first longitudinal end E1 of the cradle B.

Advantageously, the third connecting member LL establishes a ball joint connection between the vessel N and the front part FO of the float F or a connection with six degrees of freedom allowing the vessel N to move with six degrees of freedom with a predetermined maximum amplitude for each degree of freedom. Consequently, even once the vessel N is coupled by its bow PR to the host ship H, the vessel N exhibits freedom of movement in rotation and optionally along the three axes of movement in translation with respect to the vessel, making it possible to avoid subjecting it to excessively high forces.

The third connecting member LL comprises, for example, a snap hook or hook device that connects the vessel to the float under the effect of a pull exerted by the vessel N on a predetermined region of the front part FO of the float. The third connecting member LL may be passive.

In a variant, the recovery device has means for detecting a pull exerted by the vessel on the predetermined region of the front part FO of the float and control means COM are configured to control the connecting element such that it connects the vessel to the float when a pull exerted by the vessel on the region of the front part of the float is detected by the detection means.

The float F has, for example, the overall shape of a U comprising a bottom FO disposed substantially next to the front end of the cradle B or to the front of the support region of the cradle B, in calm seas. The float F comprises two wings A1 and A2 that each extend longitudinally from the bottom FO, comprising the stop BU, as far as a free or rear end EA1, EA2 situated behind the bottom F along the axis x, the wings A1 and A2 being separated by a plane parallel to the axes x and z passing through the bottom FO, in calm seas. The vessel N then passes into the space delimited by the float F through an opening OV delimited by the rear ends of the wings EA1 and EA2.

The float F comprises, for example, a continuous fender in the overall shape of a U, exhibiting positive buoyancy, or a set of fenders that are able to exhibit the predetermined positive buoyancy and are connected together so as to form the overall U shape. The adjacent fenders along a curve in the overall shape of a U may be contiguous or spaced apart from one another.

Advantageously, the float F, when it exhibits the predetermined positive buoyancy, is elastically deformable so as to damp the impacts, that is to say absorb the energy of the impacts, between the vessel N and the float F, in particular when the vessel N is located inside the volume delimited by the guide float. Thus, the vessel N does not come into contact with a rigid element before being coupled to the float F.

The float F comprises, for example, a closed flexible shell that is able to enclose air and to have the overall shape of a U. The float F may be able to be alternately inflated, so as to exhibit the predetermined positive buoyancy, and deflated.

In a variant, the float comprises a U-shaped structure covered with a flexible external shell, which is elastically compressible so as to absorb the energy of impacts between the vessel N and the float F when the vessel N approaches the float F and when it passes into the volume delimited by the wings EA1 and EA2 and the bottom FO of the float F.

The float F is advantageously configured and connected to the cradle B to limit the movements of the vessel N with respect to the cradle B along the axis y, in calm seas. In this way, the longitudinal axis I of the vessel N is substantially contained in the plane (z, l), in calm seas.

Figure 8:
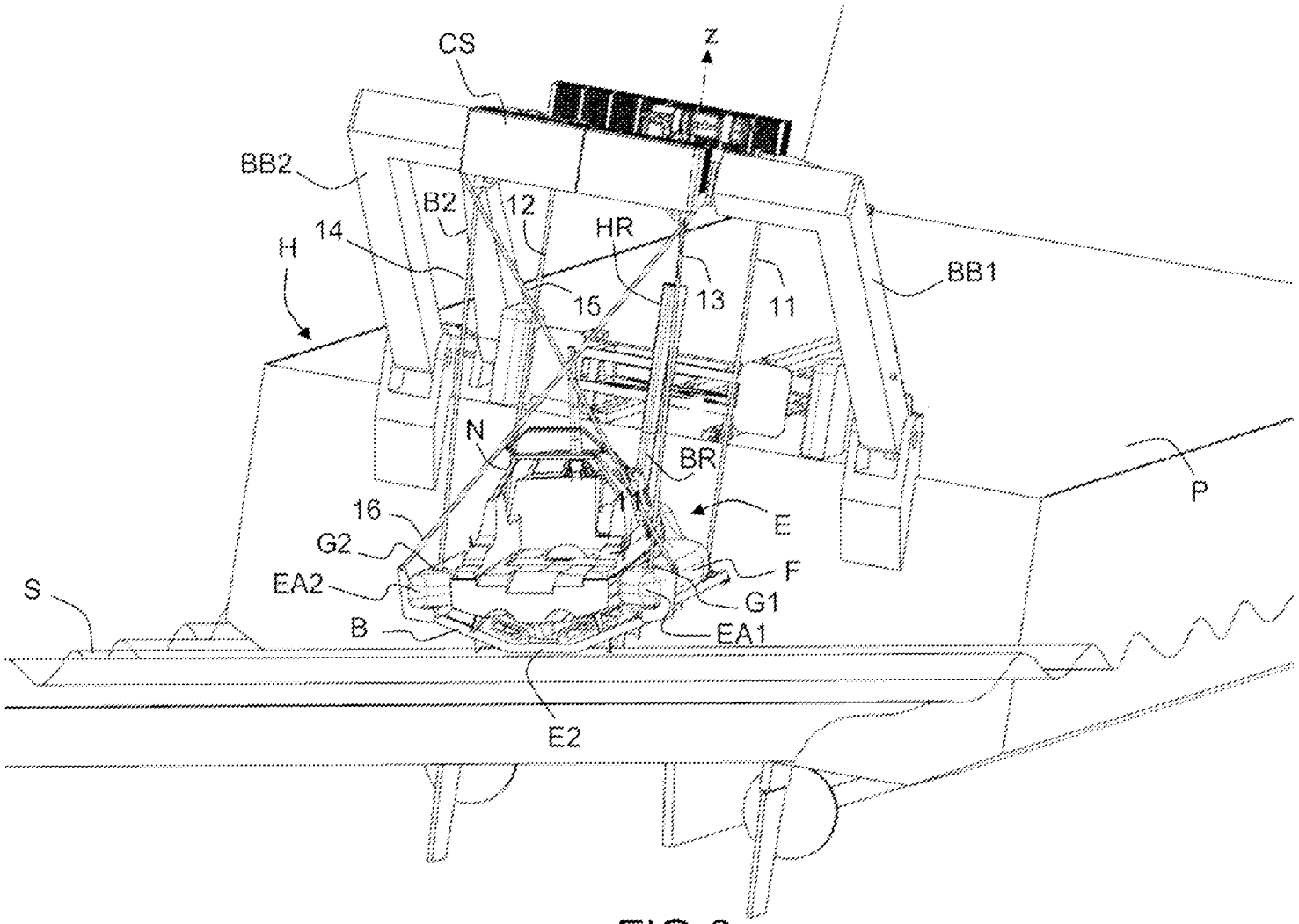

In the nonlimiting example in the figures, the lifting device comprises two openings G1, G2, visible in FIG. 8, provided in the float F.

The lifting device comprises two connecting hangers 13 and 14, among the hangers 11 to 16 which connect the cradle B to the upper frame CS. Each connecting hanger 13, 14 connects the cradle B to the upper frame CS, passing through an opening G1, G2 that is provided in the float F and radially completely surrounds the connecting hanger 13.

In other words, two openings G1, G2 are provided in the float F and entirely delimited by the float. Each connecting hanger 13, 14 passes through one of these openings G1, G2.

Each opening G1, G2 is advantageously configured and arranged such that each connecting hanger 13, 14 is able to extend substantially linearly, that is to say along a single straight line, in calm seas, when it is under tension.

The passage of the connecting hangers 13, 14 through the float F makes it possible to limit an amplitude of a rotation of the float F with respect to the cradle B about an axis perpendicular to the axis z of the rail.

This makes the approach of the vessel N easier. Furthermore, once the vessel N is engaged between the wings of the float F and when its bow PR is connected to the float F, the connection of the cradle B to the frame through the float F makes it possible to bring the longitudinal axis I1 of the vessel N closer to the plane (x, z) in calm seas, with relatively flexibility, before the vessel N rests on the cradle B. This is because the flexibility of the connecting hangers 13, 14 allows a certain oscillation of the vessel N about the axis z but the tension in the connecting hangers 13, 14 brings the longitudinal axis I1 of the vessel N closer to the plane (x, z) in calm seas. This configuration therefore makes it possible to orient the vessel N with flexibility, in the direction that allows it to cooperate optimally with the cradle B, when the cradle B is put into the hoisting orientation, and then it is hoisted. The connecting hangers serve to guide the cradle B.

Advantageously, the connecting hangers 13, 14 exert vertical pulls on the cradle B substantially at the rear end E2 of the cradle B. This makes it possible to promote the flexible placement allowed by the connecting hangers.

Advantageously, the connecting hangers 13, 14 comprise two hangers that exert vertical pulls on the cradle B at two points at a distance along the axis y when they are tensioned. In the nonlimiting example in the figures, the first opening G1 is under passes through the first wing A1 and the second opening G2 passes through the second wing A2.

Advantageously, the lifting device comprises two connecting hangers 13, 14 that are able to be separated by a plane (x, z) passing through the front FO in calm seas. This makes it possible to ensure symmetric stabilization of the float F about the plane (x, z).

In a variant, the device could comprise one or more than two connecting hangers.

In the example in FIGS. 1 to 12, the float F has an angular opening about an axis that is able to be parallel to the axis z in calm seas and a length along the axis x, these being substantially fixed when it exhibits the predetermined positive buoyancy.

In a variant, the float has a variable angular opening about an axis that is able to be parallel to the axis z in calm seas and/or a variable length.

Figure 13:
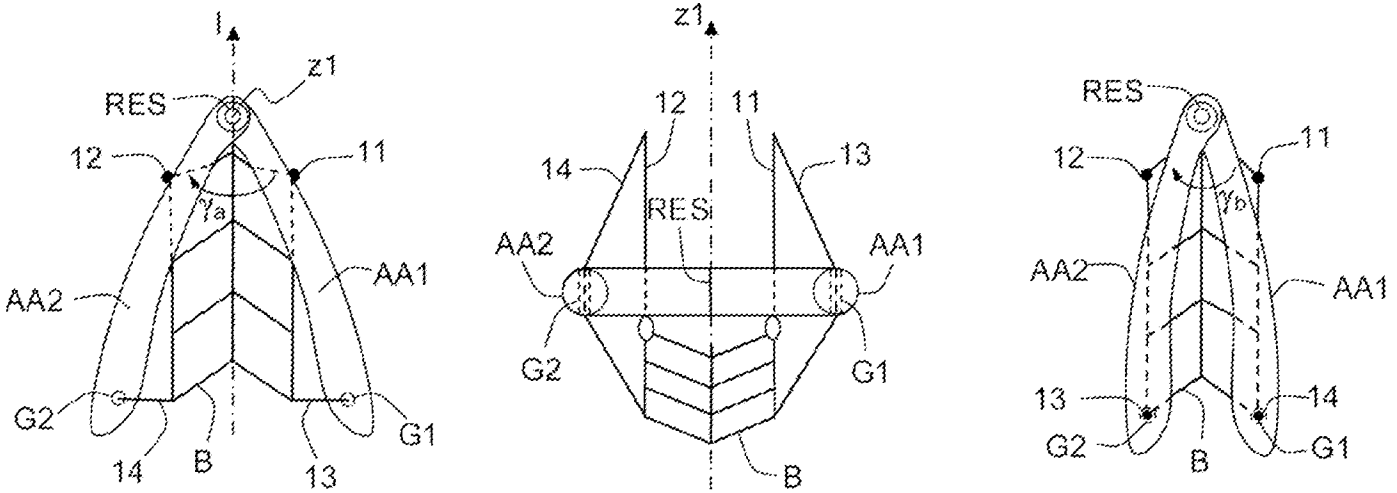
FIG. 13 is a schematic illustration, in top view, of a cradle linked to a float having a variable angular opening, in top view (on the left), in rear view (in the middle) and in top view, after a reduction in the angular opening of the float (on the right).

In the example in FIG. 13, the float FF differs from the one in the previous figures in that it has a variable angular opening. Furthermore, the device differs from the one in the previous figures in that it does not comprise stabilizing hangers. It could, in a variant, comprise stabilizing hangers.

Its two wings AA1 and AA2 are able to pivot with respect to one another about an axis z1 that is able to be parallel to the axis z in calm seas. The wings are connected by a torsion spring RES which tends to give the float F a large docking angular opening γa as shown schematically in a top view in the left-hand view in FIG. 13 and in a rear view in the middle view. The docking angular opening γa is obtained under the effect of appropriate lengthening of the connecting hangers 13, 14 making it possible to slacken the connecting hangers 13, 14 which allow the wings AA1 and AA2 to move apart under the effect of the load exerted by the spring. The connecting hangers 13 and 14 extend along a curved line comprising two substantially straight lines. By reducing the length of the connecting hangers 13, 14, the angular opening of the float F decreases under the effect of a reduction in the length of the hangers 13 and 14, placing them under tension, until the float F has a hoisting angular opening γh, visible in the right-hand view, in which the connecting hangers 13 and 14 are tensioned and extend linearly, that is to say each extend longitudinally along a single straight line.

The connecting hangers 13 and 14 are advantageously, but not necessarily, substantially parallel to one another when the float F has the hoisting angular opening γh.

Advantageously, the cradle B comprises at least one damper AM for damping an impact between the cradle B and the region of the vessel N when the cradle B is raised to bring it into contact with the vessel N.

The gondola NA may adopt different shapes depending on the type of vehicle it is intended to transport. The gondola NA is, for example, without a float F, and the gondola NA, which is then entirely submersible, is designed to recover underwater vehicles, or the float F is integrated into the cradle B such that the cradle B floats, the gondola then floating and being designed to recover floating vehicles.

In the example in the figures, the guide is a rail R. The guide may be any other type of guide, for example a pantograph or a hydraulic guide system.

In the example in the figures, the float F is connected to the same guide R as the cradle B. In a variant, the float is connected to a second guide, the function of which is the same, namely to guide the float F in translation along the axis z.

In a variant, the device comprises a rope connecting the front part FO of the float F to a fixed point with respect to the upper frame CS.

In a variant, the float F is connected to the cradle B only by one or more connecting hangers.

In a variant, the set of hangers is without stabilizing hangers.

The control means may comprise at least one memory and at least one processor. The control means are then provided in the form of one or more stored computer programs, each computer program being stored in a memory of the computer and comprising code instructions that are able to be executed by a processor.

In a variant, the control means may be provided in the form of one or more dedicated integrated circuits or ASICs (acronym for "Application Specific Integrated Circuit") or one or more programmable logic components, for example of the FPGA (acronym for "Field Programmable Gate Array") type, configured or programmed to generate the command or commands it is intended to generate.

The invention relates to a recovery assembly comprising a surface station and a recovery device according to the invention, which is mounted on the surface station. The invention also relates to a marine assembly comprising the recovery assembly and the vessel N.

The invention claimed is:

1. A device for recovering a vessel at sea from a surface station the recovery device comprising:

a cradle to support the vessel, a lifting device comprising an upper frame and a set of hangers connecting the cradle to the upper frame, lengths of the hangers being variable so as to make it possible to hoist and lower the cradle, the set of hangers comprising a first stabilizing hanger and a second stabilizing hanger that are able to be in a stabilizing configuration wherein the first stabilizing hanger and the second stabilizing hanger are under tension and extend linearly, and wherein:

(i) a first orthogonal projection of the first stabilizing hanger on a transverse plane (y, z) defined by an axis z, which is linked to the upper frame (CS) and extends substantially vertically in calm seas, and by an axis y orthogonal to the axis z, and, (ii) a second orthogonal projection of the second stabilizing hanger on the transverse plane, are inclined with respect to one another so as to make it possible to limit swaying of the cradle with respect to the upper frame;

wherein the first orthogonal projection and the second orthogonal projection cross one another, and wherein the first stabilizing hanger and the second stabilizing hanger are able to be in a rest configuration wherein the first stabilizing hanger and the second stabilizing hanger are under tension and wherein a third orthogonal projection of the first stabilizing hanger on the transverse plane and a fourth orthogonal projection of the second stabilizing hanger on the transverse plane exhibit a smaller inclination with respect to one another than in the stabilizing configuration, such that swaying of the cradle with respect to the upper frame is more limited when the hangers are in the stabilizing configuration than when they are in the rest configuration.

2. The recovery device as claimed in claim 1, wherein the vessel is intended to rest on the cradle under the effect of gravity while the vessel is being hoisted.

3. The recovery device as claimed in claim 1, comprising an attachment connecting a first attachment point of the cradle to a second attachment point that is fixed, in the receiving configuration, with respect to the upper frame in translation along the axis y and/or along an axis x orthogonal to the axis y and to the axis z.

4. The recovery device as claimed in claim 1, comprising:

a connecting piece connected to the cradle with three degrees of freedom of rotation, a guide for guiding the connecting piece in translation along the axis z, with respect to the upper frame, during a variation in length of the hangers.

5. The recovery device as claimed in claim 4, wherein the connecting piece is connected to the cradle by a ball joint connection or a connection with three degrees of freedom of rotation and one degree of freedom of movement in translation along an axis parallel to an axis x linked to the upper frame and perpendicular to the axis y and to the axis z.

6. The recovery device as claimed in claim 1, wherein the recovery device is configured to recover a vessel moving on the surface of the water in calm seas, preferably along an axis of forward movement parallel to an axis x linked to the upper frame and perpendicular to the axis y and to the axis z.

7. The recovery device as claimed in claim 1, wherein the set of hangers also comprises hoisting hangers disposed so as to make it possible to hoist the cradle with zero list in calm seas and to adjust an attitude of the cradle.

8. The recovery device as claimed in claim 7, wherein each hoisting hanger has an orthogonal projection on a plane (x, y) that is able to exhibit a single predetermined orientation in calm seas, when the hoisting hanger is under tension and extends linearly.

9. The recovery device as claimed in claim 1, comprising means for adjusting the lengths of the hangers, said means being configured to keep the hangers of the set of hangers substantially under tension during a stabilized hoisting step during which the adjusting means hoist the cradle toward the upper frame, the recovery device being in the recovery configuration and the stabilizing hangers being in the stabilizing configuration.

10. The recovery device as claimed in claim 9, wherein the adjusting means are configured to keep the hangers of the set of hangers under tension during the stabilized hoisting step.

11. The recovery device as claimed in claim 9, wherein the adjusting means are configured to continuously reduce the lengths of the hangers of the set of hangers during the stabilized hoisting step.

12. The recovery device as claimed in claim 1, comprising connecting means for connecting a bow of the vessel to the cradle so as to prevent the vessel from moving forward along the axis x with respect to the cradle.

13. A method for stabilizing a cradle of a recovery device as claimed in claim 1, during which the hangers of the set of hangers are kept substantially under tension, the stabilizing hangers being in the stabilizing configuration.

14. A method for hoisting a vessel at sea using a recovery device as claimed in claim 1, comprising a stabilized hoisting step during which the cradle is hoisted toward the upper frame under the effect of a variation in length of the hangers, the recovery device being in the recovery configuration and the stabilizing hangers being in the stabilizing configuration.

* * * * *